United States Patent [19]

Kimoto et al.

[11] 3,959,559

[45] May 25, 1976

[54] PROCESS FOR PRODUCING MODIFIED SYNTHETIC FIBERS

[75] Inventors: Masakazu Kimoto; Isoo Shimonishi, both of Takatsukishi, Japan

[73] Assignee: Asahi Kasei Kogyo Kabushiki Kaisha, Osaka, Japan

[22] Filed: June 11, 1974

[21] Appl. No.: 478,366

[30] Foreign Application Priority Data

June 29, 1973 Japan ..... 48-72836

[52] U.S. Cl. ..... 428/394; 8/115.5; 8/115.6; 260/49; 260/844; 427/342; 428/395

[51] Int. Cl.[2] ..... D06M 13/30; D06M 13/54

[58] Field of Search ..... 8/115.5; 427/342; 428/394, 395

[56] References Cited

UNITED STATES PATENTS 2,931,694 4/1960 Wirth et al. ..... 8/115.5

3,322,488 5/1967 Feeman ..... 8/115.5

FOREIGN PATENTS OR APPLICATIONS 909,600 10/1962 United Kingdom ..... 8/115.5

*Primary Examiner*—Murray Tillman
*Assistant Examiner*—A. H. Koeckert
*Attorney, Agent, or Firm*—Armstrong, Nikaido & Wegner

[57] ABSTRACT

Modified synthetic fibers having durable antistatic property, hygroscopic property and anti-fouling property at the same time are obtained by adhering onto the surface of synthetic fibers, a small amount of reaction product of a s-triazine derivative or a piperazine derivative expressed by a certain general formula (I)-*a* or (I)-*b*, with a derivative of polyoxyethylene expressed by a general formula (II) (pretreatment), and further adhering onto the resulting fibers, a small amount of an aromatic sulfonic acid expressed by a general formula (III) (post-treatment).

12 Claims, No Drawings

PROCESS FOR PRODUCING MODIFIED SYNTHETIC FIBERS

FIELD OF THE INVENTION

This invention relates to a process for producing synthetic fibers of improved qualitites by post-treatment of synthetic fibers, and more particularly to a process for producing synthetic fibers of polyamides, polyesters, polyacrylonitriles, polyolefins, etc. with improved qualities, such as excellent, durable anti-static property, good hydroscopic property and good anti-fouling property, endowed at the same time by post-treatment of such synthetic fibers.

Since these synthetic fibers have generally had such disadvantages as the absence of the hydroscopic property, occurrence of static electricity, liability of fouling, etc., many processes have been so far proposed to improve these disadvantages. However, the proposed processes have been often directed to the individual improvements of these hygroscopic property, anti-static property and anti-fouling property of the fibers. Though attempts have been proposed to improve these three properties at the same time, the resulting fibers have not been accompanied with durability of the properties. Thus, none of industrially satisfactory processes has been realized yet.

DESCRIPTION OF THE PRIOR ART

It is known that polyoxyethylenes or their polyethylene oxide adducts or glycidyletherified products can endow the hygroscopic property and anti-static property to these synthetic fibers, but these compounds fail to satisfy the anti-fouling property or meet the required durability. Furthermore, when a dry cleaning or washing bath is contaminated with liberated dyestuff or ionic contaminants, these compounds have a disadvantage of serious fouling.

Still further, when these synthetic fibers are dyed products with disperse dyes, they have such drawbacks that oxyethylene constituting the basic substance of the modifier promotes the bleeding action of dyes and reduction in fastness occurs due to the change with lapse of time.

As a result of strenuous studies to eliminate these disadvantages of the prior art, the present inventors previously found that a good hygroscopic property, antistatic property and anti-fouling property could be effectively endowed at the same time together with their good durabilities to the synthetic fibers by adhering onto the surface of synthetic fibers, 0.2 to 8% by weight based on the weight of the fibers of a reaction product of either one of a s-triazine derivative or a piperazine derivative, expressed by the general formula (I)-A

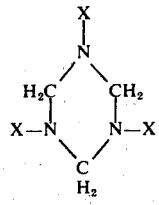

or (I)-B

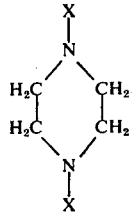

(wherein X shows any one of $-CH_2CH=CH_2$, $-COCH=CH_2$,

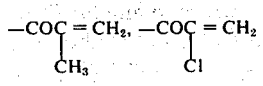

and $-COCH_2CH_2Cl$), with a compound expressed by the general formula (II) $X'\text{-}(R)_n\text{-}X'$ (wherein X' shows $-NH_2$, $-NHCH_3$, $-SO_2NH_2$, $-SO_2CH_2CH_2NH_2$ or $-COCH_2NH_2$; R shows oxyethylene group; and *n* shows an integer at which the molecular weight of the general formula (II) fall within the range of 200–5000).

However, it was found that when dry cleaning or washing bath contained liberated dyes or ionic contaminants, the synthetic fibers were remarkably contaminated and also, in the case of dyed products with disperse dyes, reduction in fastness occurred due to the change with lapse of time.

As a result of further studies to overcome such a drawback, the present inventors have found that effectivenesses of no fouling in a dry cleaning or washing bath containing the liberated dyes or ionic contaminants, as well as no reduction in fastness in the case of dyed products with disperse dyes, can be brought about by adhering onto the surface of fibers, the above-mentioned reaction product of any one of a s-triazine derivative or a piperazine derivative expressed by the general formula (I)-A or (I)-B, with a compound expressed by the general formula (II), and thereafter adhering onto the surface of the resulting fibers, 0.05–3% by weight based on the weight of the fibers of an aromatic sulfonic acid expressed by the general formula (III)

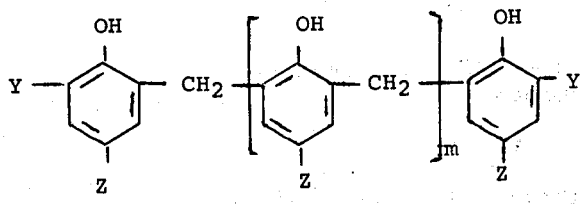

(wherein Y shows —H, $-CH_2OH$ or $-CH_2SO_3H$; Z shows $-SO_3H$, $-CH_2SO_3H$,

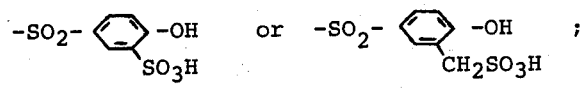

and *m* shows an integer of 5–20), and further have found that the antistatic property, hygroscopic property, anti-fouling property and their durabilities can be considerably improved by the present post-treatment by said aromatic sulfonic acid, as compared with those attained without the post-treatment, and have accomplished the present invention.

BRIEF SUMMARY OF THE INVENTION

The present invention resides in a process for producing modified synthetic fibers having antistatic, hygroscopic and anti-fouling properties which comprises adhering onto the surface of synthetic fibers, 0.2–8% by weight based on the weight of the fibers of a reaction product of either one of a s-triazine derivative or a piperazine derivative expressed by the general formula (I)-A 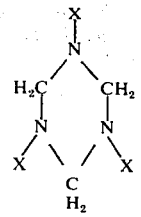 or (I)-B 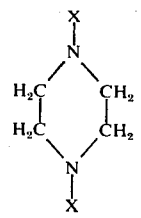

(wherein X shows $-CH_2CH=Ch_2$, $-COCH=CH_2$, $-COC(CH_3)=CH_2$, $-COC(Cl)=CH_2$ or $-COCH_2CH_2Cl$), with a compound expressed by the general formula $$X'-(-R-)_n X' \qquad \text{(II)}$$

(wherein X′ shows $-NH_2$, $-NHCH_3$, $-SO_2NH_2$, $-SO_2CH_2CH_2NH_2$ or $COCH_2NH_2$; R shows oxyethylene group; and n shows an integer at which the molecular weight of the general formula (II) falls within the range of 200–5000), and thereafter adhering onto the surface of the resulting fibers, 0.05–3% by weight based on the weight of the fibers or an aromatic sulfonic acid expressed by the general formula of (III)

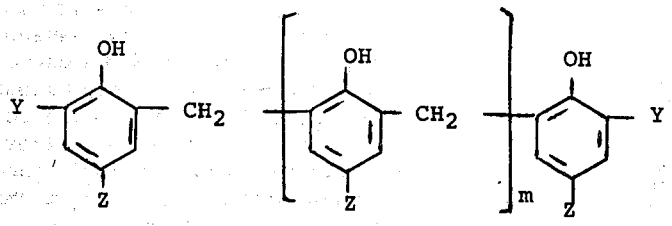

(wherein Y shows $-H$, $-CH_2OH$ or $-CH_2SO_3H$; Z shows $-SO_3H$, $-CH_2SO_3H$,

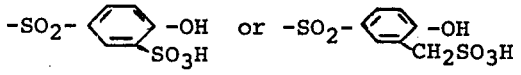

and *m* shows an integer of 5–20).

DETAILED DESCRIPTION OF THE INVENTION

It is desirable that the compounds expressed by the general formula (II), $X'-(-R-)_nX'$, and used in the present invention have a molecular weight of 200 to 5,000, preferably 400–3,000. If the compounds having a molecular weight of less than 200 are used, introduction of the functional group becomes difficult. If the compounds having a molecular weight more than 5,000 are used, dissolution of the compounds in a solvent becomes difficult, also handling thereof becomes troublesome, and further the feeling of the resulting fibers is liable to become rigid. As for the compounds represented by the general formula $X'-(-R-)_nX'$ to be used in the present invention, the following ones are illustrated: diaminopolyoxyethylene glycol, dimethylaminopolyoxyethylene glycol, disulfamoylpolyoxyethylene glycol, ditaurylpolyoxyethylene glycol, diglycylpolyoxyethylene glycol, etc.

Further, as for the s-triazine derivatives and piperazine derivatives represented by the above-mentioned general formula (I)-A or (I)-B, to be reacted with the compounds represented by the general formula $X'-(-R-)_nX'$, the following ones are illustrated:

1,3,5-tris-acryloyl-hexahydro-s-triazine,
1,3,5-tris-methacryloyl-hexahydro-s-triazine,
1,3,5-tris-allyl-hexahydro-s-triazine,
1,3,5-tris-β-chloropropionyl-hexahydro-s-triazine,
1,3,5-tris-α-chloroacryloyl-hexahydro-s-triazine,
1,4-diacryloylpiperazine,
1,4-diallylpiperazine.
1,4-dimethacryloylpiperazine,
1,4-β-chloropropionylpiperazine,
1,4-α-chloroacryloylpiperazine, etc.

These compounds are reacted with the compounds represented by the general formula (II), $X'-(-R-)_nX'$, to form polymers having a complicated three-dimensional structure. The mixing ratio by mol of the compounds represented by the general formula (II), $X'-(-R-)_nX'$, to the above-mentioned compounds is usually 1:4 to 4:1, preferably 2:3 to 3:2. The resulting reactant mixture having said molar ratio is dissolved in water or a good solvent to either of both the reactant compounds, which does not damage the fibers to be applied with the mixture, or a mixture of said good solvent and water to obtain a solution, and fiber products are treated with a treating bath consisting of said solution and then heat-treated at a temperature lower than the melting point of the fibers to effect reaction of these reactant compounds on the surfaces of the fiber products, thereby adhering the resulting reaction products onto the surfaces of the fiber products as they are.

It is desirable for carrying out the reaction that the treating bath is alkaline, but it is not always necessary to especially add an alkaline substance to the bath, because the above-mentioned treating bath itself is alkaline. However, of course, an alkaline substance can be further added to the bath, if necessary.

It is desirable to adhere 0.2 to 8% by weight, preferably 0.5 to 4% by weight of the reaction product on the surfaces of the fiber products, on the basis of the weight of the fiber products. If the amount adhered is less than 0.2% by weight, the excellent effect of the present invention cannot be obtained fully. If the amount exceeds 8% by weight, the feeling of the resulting fiber products becomes slimy or rough and rigid, and of course a cost disadvantage results. The resulting fiber products obtained by using the compounds represented by the formula (I)-A or (I)-B and the compounds represented by the general formula (II) in the manner as mentioned above, are further subjected to post-treatment with an aromatic sulfonic acid represented by the general formula (III).

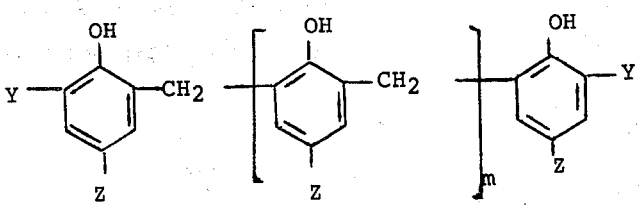

(III)

(wherein Y shows —H, —$CH_2OH$ or —$CH_2SO_3H$; Z shows —$SO_3H$, —$CH_2So_3H$,

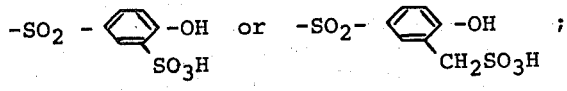

and *m* shows an integer of 5 to 20).

As for the aromatic sulfonic acids represented by the general formula (III), the following ones are illustrated: sulfonated products or sulfomethylated products of 4,4'-dihydroxydiphenyl-sulfone-formaldehyde condensates; sulfonated products or sulfomethylated products of condensates of phenol and formaldehyde, etc.

It is desirable that *m* of the general formula (III) standing for the aromatic sulfonic acids is an integer of 5 to 20, preferably 8 to 15. If *m* is less than 5, the anti-fouling effect cannot be attained fully. If *m* exceeds 20, the feeling is liable to become rigid.

It is appropriate to adhere 0.05–3% by weight, preferably 0.1–2% by weight of the compounds of the general formula (III) onto the surfaces of the fiber products in said post-treatment on the basis of the weight of the fiber products. If less than 0.05% of the compounds is adhered, the excellent effect of the present invention cannot be obtained fully. On the other hand, if the amount adhered exceeds 3% by weight, the feeling of the resulting fiber products is liable to become slimy or rough and rigid.

According to the two-step process of the present invention, the surfaces of the fiber products resulting from the first step treatment are ionically sulfonated by the second step treatment, and at the same time a synergistic effect can be obtained owing to the involvement of the group —$SO_3H$. All of the antistatic property, hygroscopic property and anti-fouling property of the fiber products can be notably improved thereby together with their improved durabilities, as compared with those of the fiber products resulting only from the first step treatment without the second step treatment. Furthermore, an excellent effect upon inhibition of contamination due to a washing or dry cleaning bath can be attained even if the dry cleaning or washing contain liberated dyes or ionic contaminants.

Further, in the case of dyed products with disperse dyes, such effectivenesses can be obtained that the bleeding action of the dyes is inhibited and also the reduction in fastness during the lapse of a long time or on heating is notably inhibited.

In addition, as for the aromatic sulfonic acids to be used in the two-step treatment of the present invention, naphthalene derivatives, polystyrene sulfonic acids, etc. can be also used besides the above-mentioned phenol derivatives, but they are not suitable for practical use, since a remarkable discoloration occurs in the case of naphthalene derivatives, while a remarkable hardening of feeling occurs in the case of polystyrene sulfonic acids. Further, such lower molecular weight sulfone compounds as phenol sulfonated compounds of cyanuric chloride can be also used, but they have a drawback that the aimed effectivenesses cannot be attained fully.

MODE OF OPERATION OF THE INVENTION

Now, the present invention will be illustrated in detail below, by way of examples, but the present invention will not be limited only to these modes of practice embodied in the examples.

In the following examples, the antistatic property, hygroscopic property, anti-fouling property and contamination by washing or dry cleaning bath were determined in the following manners.

As to the antistatic property, a half-value period was measured at 25°C and 40% relative humidity (RH) by an honestmeter.

As to the hygroscopic property, a degree of elevation of water through cloth was measured at 20°C and 60% RH according to Weireck method ( JIS L-1079,5-25-1, procedure B*) (Note, JIS: Japanese Industrial Standards).

As to the anti-fouling property, a test sample was brought in contact with a fouling solution shown in Table 1 at 80°c for 20 minutes by means of a launder-O meter**, and the degree of fouling was judged by way of classes by a gray scale.

As to the washing conditions for observing the durabilities of the performances, a domestic washer was used and test sample was subjected to laundry with 0.5% solution of a neutral detergent, at 40°C for 5 minutes, followed by water-washing for 10 minutes and this was rendered once-washing.

As to the method for measuring the contamination by dry cleaning, a dry cleaning solution consisting of 98 parts of perchloroethylene and 2 parts of Genbu Clean (trademark of polyoxyethylene alkylphenol phosphoric acid ester made by Daiichi kogyo Seiyaku Co. Ltd., Japan), and contaminated with 0.001 mg of a direct dye (Kayarus Supra Blue RCL, trademark of a dye manufacture by Nihon Kayaku Co., Ltd.) was used. A test sample was treated with the contaminated dry cleaning solution for 20 minutes by a launder-O meter and the contaminated state of the test sample was judged by way of classes by a grey scale.

As to the method for measuring the contamination by washing, 100 cc of 0.5% aqueous solution of Marseilles soap, contaminated with 0.001 mg of a direct dye (Kayarus Supra Blue RCL) as in the case of the above-mentioned dry cleaning case was used as a washing solution, and a test sample was treated with the washing solution at 50°C for 20 minutes by a launder-O meter. The contaminated state of the test sample was judged by way of classes by a grey scale.

* Procedure B

A testpiece of 20 cm × 2.5 cm with a sample is stood. Five pieces are taken from the testpiece in the lateral direction. Each of the resulting testpieces is pinned onto a horizontal bar sustained on a given level above a water vessel containing distilled water at 20° ± 2°C. The horizontal bar is lowered under arrangement of the lower ends of the testpieces in a line so that the lower ends of the testpieces may be just dipped into water. A steel scale is hung from the horizontal bar together with the testpieces, by which scale the height (mm) of water elevated for 10 minutes due to capillary phenomenon is measured(31). The test is carried out five times, and the objective value is expressed by the average one thereof (mm) (down to integer order).

Note: The higher the value, the better the water absorptivity.

(31): When the elevation of water due to capillary phenomenon is difficult to observe, a water-soluble dye (such as eosine) is attached onto a hair-brush of camel and scattered on the testpieces.

** Launder-O meter employed by AATCC (American Association of Textile Chemists and Colorists).

Table 1

| Composition of contaminated solution for determination of anti-fouling property. | |
|---|---|
| Stearic acid | 5 mg |
| Oleic acid | 5 mg |
| Tristearin | 5 mg |
| Oleyl alcohol | 5 mg |
| Solid paraffin | 9 mg |
| Carbon black | 9 mg |
| Sodium chloride | 20 mg |
| Sodium alkylbenzenesulfonate | 150 mg |
| Water | 100 g |

Further, as to the measurement of fastness in the case of the dyed products with disperse dyes, the color fastness to rubbing* after dry heat-treatment thereof at 150°C, for 5 minutes, was measured in order to observe change in fastness during the lapse of days after reduction cleaning and in case where the dyed products were allowed to stand for a long period of time. As to the color fastness to dye transfer**, treatment was carried out for 24 hours by applying a load of 200 g to a sample in the atmosphere at 50°C and 90% RH, and the contaminated state was judged by way of classes.

* Measured according to AATCC 8-1961 (USAS L14, 72-1963)

** Measured according to I.S.O. (International Standard of Organization), Recommendation R 105, test for colour fastness of textiles, part 22, colour fastness of water.

In the following examples, parts and percentage are by weight.

EXAMPLE 1

900 parts of an aqueous 6% solution of dimethylaminopolyoxyethylene glycol (molecular weight: 1,000) and 100 parts of a 10% acetone solution of 1,4-diacryloyl-piperadine were mixed together to prepare a treating solution.

Nylon 6.6 twill, polyester jersey* and acrylonitrile jersey** were dipped in the resulting treating solution, and squeezed to percentages pick-up of 30%, 110%, and 80%, respectively, and subjected to drying and heat treatment at 130°C for 7 minutes.

* Polyester jersey consisting of polyethylene terephthalate fibers, made by Asahi Kasei Kogyo Kabushiki Kaisha, Japan. Polyester jersey described in the following Examples means this product.

** Acrylonitrile jersey consisting of acrylonitrile polymer synthetic fibers, made by Asahi Kasei Kogyo Kabushiki Kaisha, Japan.

These test samples were each divided into two parts, and the half parts were subjected to post-treatment, that is, dipped in an aqueous 1% solution of 4,4'-dihydroxy-diphenylsulfone-formaldehyde condensate having the following structure, squeezed and dried at 110°C for 3 minutes.

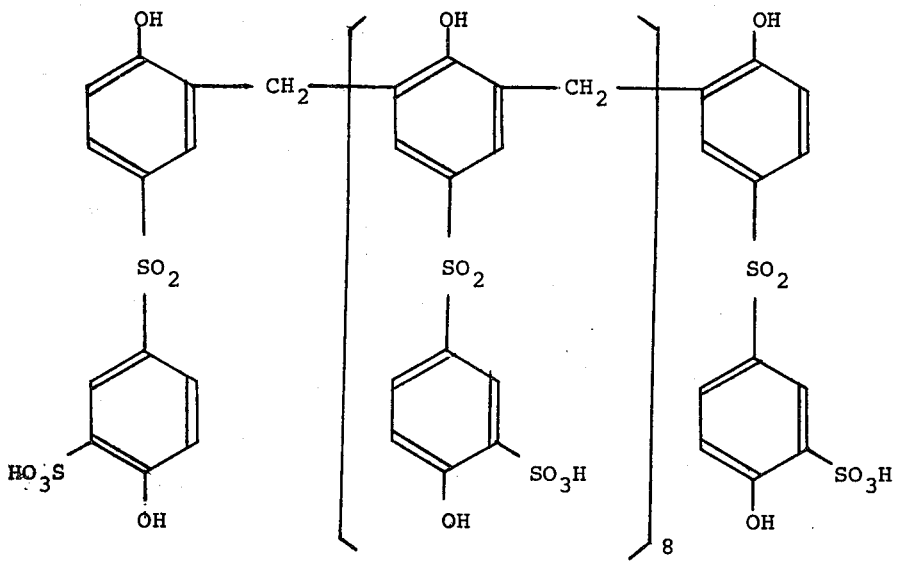

Then, the post-treated test samples were washed 20 times, and their antistatic property, hygroscopic property, anti-fouling property and contamination by washing and dry cleaning were determined. For control, unprocessed cloth was observed at the same time. The results are shown in Table 2, which indicates that the sample fabrics treated according to the present invention have excellent durable antistatic property, hygroscopic property and anti-fouling property, and an excellent effect upon prevention of contamination due to dye-contaminated washing or dry cleaning solution, as compared with those of the unprocessed cloth or the cloth without the post-treatment (the other half parts).

Table 2

| | | Antistatic property half-value period (sec.) | Hygroscopic property (cm) | Anti-fouling property (class) | Dry cleaning contamination (class) | Washing contamination (class) |
|---|---|---|---|---|---|---|
| 6.6 Nylon twill | Unprocessed | >600 | 0.5 | 1 | 1 | 1 |
| | Without post-treatment | 23 | 4.2 | 3 | 1 | 1 |
| | Present invention | 6 | 6.1 | 4–5 | 4 | 4–5 |
| Polyester jersey | Unprocessed | >600 | 0 | 1 | 4 | 4 |
| | Without post-treatment | 18 | 7.1 | 3 | 2 | 1 |
| | Present invention | 2 | 11.5 | 4–5 | 4–5 | 5 |
| Polyacrylonitrile jersey | Unprocessed | >600 | 1.5 | 1 | 5 | 4–5 |
| | Without post-treatment | 21 | 5.3 | 3 | 2 | 2 |
| | Present invention | 3 | 9.1 | 4–5 | 5 | 5 |

Note:
the values obtained after 20 washings

EXAMPLE 2

700 parts of 2% aqueous solution of diglycylpolyoxyethylene glycol (molecular weight: 3,000) and 300 parts of 2% acetone solution of 1,3,5-tris-allylhexahydro-s-triazine were mixed together to prepare a treating solution.

A polyester jersey dyed with 5% o.w.f.* of Celliton Orange-GR (tradename of dye manufactured by BASF CO.; C.I.*: Disp. 0–3) and 5% o.w.f. of Resolin Red BRL (tradename of dye manufactured by Bayer Co.; C.I.: Disp. R-134) were dipped in the above-mentioned treating solution, squeezed at a percentage pick-up of 80%, dried at 130°C for 3 minutes and further heat-treated at 160°C for 30 seconds.

* (Note, o.w.f.: on the weight of fibers; C.I.: color index).

After reduction cleaning, test samples were divided into two parts. The half parts for post-treatment were subjected to dipping treatment at 150°C for 5 minutes in 0.5% aqueous solution of sulfonated product of 4,4'-dihydroxy-diphenylsulfone-formaldehyde condensate.

The samples subjected to reduction cleaning alone and those subjected to post-treatment were further divided into two parts, and the half parts were subjected to dry heat-treatment at 150°C for 5 minutes to observe color fastness to rubbing and color fastness to dye transfer. Further, for control, a sample to which 1% o.w.f. of Ceranine RW (trademark of a product manufactured by Sandz Co.) as a temporary sweat-absorbing agent was attached, was observed at the same time. The results are shown in Table 3, which indicates that even after the heat-treatment, the products obtained according to the process of the present invention do not cause any reduction in the fastness and this excellent fastness is well maintained. These samples were repeatedly washed 10 times, and the products according to the process of the present invention maintained their superior antistatic property and hygroscopic property, as seen from the results shown in Table 4.

Table 3

| Dye | Sample | | Color fastness to rubbing | Color fastness to dye transfer |
|---|---|---|---|---|
| Celliton Orange-GR | No post-treatment | Prior to heat-treatment | 4–5 | 5 |
| | | After heat-treatment | 2 | 2–3 |
| | Present invention | Prior to heat-treatment | 5 | 5 |
| | | After heat-treatment | 5 | 5 |
| | Temporary sweat-absorbing treatment | Prior to heat-treatment | 4 | 4–5 |
| | | After heat-treatment | 1–2 | 1–2 |
| Resolin Red BRL | No post-treatment | Prior to heat-treatment | 4–5 | 5 |
| | | After heat-treatment | 1–2 | 2 |
| | Present invention | Prior to heat-treatment | 5 | 5 |
| | | After heat-treatment | 4–5 | 5 |
| | Temporary sweat-absorbing treatment | Prior to heat-treatment | 4 | 4 |
| | | After heat-treatment | 1 | 1 |

Table 4

| Dye | Sample | (Values after 10 times washings) Antistatic property Half-value period, sec. | Hygroscopic property (cm) |
|---|---|---|---|
| Celliton Orange-GR | No post-treatment | 24 | 7.6 |
| | Present invention | 13 | 11.8 |
| | Temporary sweat-absorbing treatment | >600 | 0.5 |
| Resolin Red BRL | No post-treatment | 21 | 8.2 |
| | Present invention | 9 | 12.0 |
| | Temporary sweat-absorbing treatment | >600 | 0.3 |

EXAMPLE 3

Two parts of diaminopolyoxyethylene glycol (molecular weight: 2,000) and 2 parts of 1,4-α-chloroacryloylpiperazine were dissolved in 96 parts of methanol to prepare a treating solution. A polyester jersey dyed with each 5% o.w.f. of the same Celliton Orange-GR and Resolin Red BRL as in Example 2 was subjected to dry heat-treatment and post-treatment under the same conditions as in Example 2, followed by measuring color fastness to rubbing and color fastness to dye transfer in the same manner. Even after heat-treatment at 150°C, for 5 minutes, the resulting product maintained the fastness of classes 4–5 or more.

EXAMPLE 4

10 parts of disulfamoylpolyoxyethylene glycol (molecular weight: 400) and 3 parts of 1,3,5-tris-methacryloylhexahydro-s-triazine were dissolved in 87 parts of methanol to prepare a treating solution.

A scoured cloth of 6-nylon taffeta was dipped into the resulting treating solution, squeezed to a percentage pick-up of 35%, dried with air, and heat-treated at 170°C for 30 seconds.

Then, the resulting cloth was subjected to post-treatment, that is, dipped in 3% aqueous solution of sulfomethylated product of 4,4'-dihydroxydiphenylsulfone-formaldehyde condensate having the following structure, squeezed, and dried at 130°C for 1 minute.

The resulting treated cloth had excellent antistatic property, hygroscopic property and anti-fouling property and an excellent effect upon prevention of contamination due to the washing and dry cleaning similar to those in Example 1.

EXAMPLE 5

500 parts of 4% aqueous solution of diglycylpolyoxyethylene glycol (molecular weight: 3,000) and 500 parts of 1% aqueous solution of 1,3,5-tris-acryloylhexahydro-s-triazine were mixed together to prepare a treating solution, and a scoured cloth of polyester taffeta was dipped in the resulting solution, squeezed (percentage pick-up: 38%) and finished under the same conditions as in Example 1. Then, the cloth was subjected to post-treatment, that is, dipped into 4% aqueous solution of p-phenolsulfonic acid-formaldehyde condensate (degree of condensation $m = 10$), squeezed and dried at 120°C for 1 minute.

Properties of the resulting cloth were compared with those of untreated cloth. The untreated cloth showed a half-value period of 600 sec. or longer, a hygroscopic property of zero cm, and an anti-fouling property of class 1 to 2, whereas the cloth treated according to the present process showed such excellent properties as a half-value period of 2 sec., a hygroscopic property of 6 cm, an anti-fouling property of class 5, and an effect upon prevention of contamination due to washing and dry cleaning, of class 5.

EXAMPLE 6

800 parts of 2% aqueous solution of ditaurylpolyoxyethyleneglycol (molecular weight: 2,000) and 200 parts of 8% acetone solution of 1,4-diallylpiperazine were mixed together to prepare a treating solution. A scoured cloth of 6-nylon jersey was dipped into the resulting treating solution, squeezed to a percentage pick-up of 80%, dried at 130°C for 4 minutes, and heat-treated at 150°C for 1 minute. Then, the resulting cloth was subjected to reduction cleaning, freed from the solution, and subjected to post-treatment, that is, dipped in an aqueous solution containing each 2% of sulfonated product of 4,4'-dihydroxy-diphenylsulfone-formaldehyde condensate and sulfomethylated phenol-formaldehyde condensate as used in Examples 1 and 4, squeezed, and dried at 130°C for 3 minutes. For con-

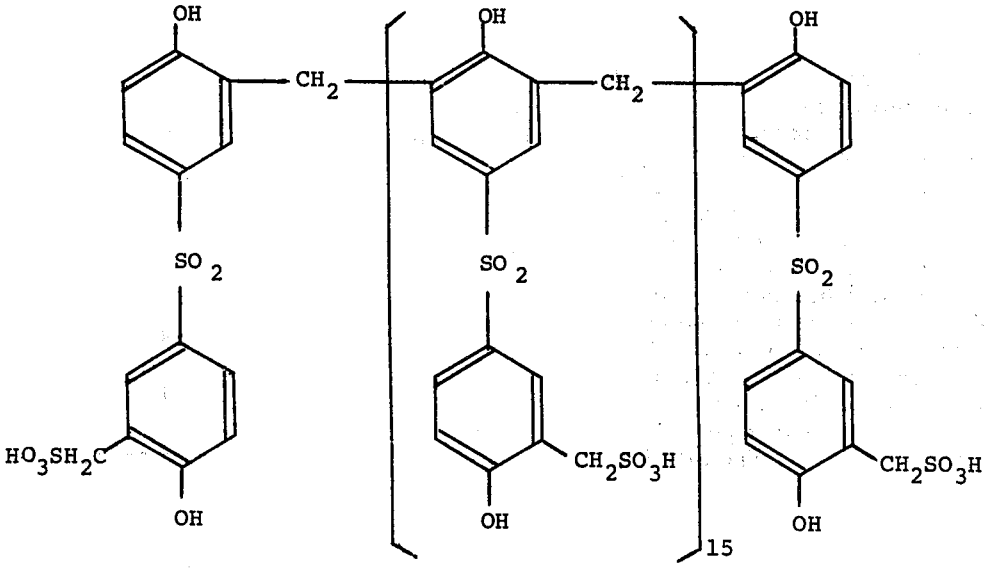

trol, a sample subjected to pretreatment alone, and a sample subjected to post-treatment alone without pretreatment were prepared, and subjected to determinations.

The results obtained after 5 times washings are shown in Table 5, which indicates that the cloth treated according to the present process had excellent antistatic property, hygroscopic property, and anti-fouling property and an excellent effect upon prevention of contamination due to washing and dry cleaning, as compared with those of the sample subjected to pretreatment alone. Further, none of these effects were observed at all in the sample subjected to post-treatment alone with sulfonated product of 4,4′-dihydroxydiphenylsulfone-formaldehyde condensate and sulfomethylated product of phenol-formaldehyde condensate. It is seen from these results that the excellent properties and effect of the present invention are obtained only by a combination of the pretreatment and the post-treatment.

Table 5

| | Post-treating agent | Antistatic property [half-value period (sec.)] | Hygroscopic property (cm) | Anti-fouling property (class) | Washing contamination (class) | Dry cleaning contamination (class) |
|---|---|---|---|---|---|---|
| Pre-treatment alone | | 13 | 8.2 | 3–4 | 1 | 1 |
| Post-treatment alone | Sulfonated product of 4,4′-dihydroxy-diphenyl-sulfone-formaldehyde condensate | >600 | 0.8 | 1–2 | 2 | 1–2 |
| | Sulfomethylated product of phenol-formaldehyde condensate | >600 | 0.5 | 1–2 | 2 | 2 |
| Present invention | Sulfonated product of 4,4′-dihydroxy-diphenyl sulfone-formaldehyde condensate | 2 | 12.5 | 4–5 | 4–5 | 5 |
| | Sulfomethylated product of phenol-formaldehyde condensate | 1 | 12.3 | 4–5 | 4–5 | 5 |

Note:
Values obtained after 5 times washings.

EXAMPLE 7

A polyester jersey dyed with 4% o.w.f. of Diacelliton Fast Pink B (tradename of dye manufactured by Mitsubishi Kasei Co., Japan; C.I.: Disp. R-15) was dipped in 1,000 parts of three kinds of acetone solutions (as treating solutions) containing 40 parts of diaminopolyoxyethylene glycol (molecular weight: 1,000) and 30 parts of 1,3,5-tris-β-chloropropionylhexahydro-s-triazine or 1,4,-β-chloropropionylpiperazine or 1,4-dimethacryloylpiperadine, squeezed and subjected to dry heat-treatment at 140°C, for 6 minutes. After reduction cleaning, the resulting cloth was subjected to dipping treatment with 1% aqueous solution of sulfomethylated product of 4,4′-diphenylsulfone-formaldehyde condensate, at 80°C for 3 minutes. After dehydration, the resulting cloth was dipped in 1% solution of Ceranine RW to control the feeling, squeezed and dried at 130°C for 3 minutes. Further, for control, untreated dyed cloth was subjected to Ceranine RW-treatment alone.

The treated cloth was subjected to dry teattreatment at 150°C for 5 minutes, and then to determinations of color fastness to rubbing and color fastness to dye transfer. The sample subjected to Ceranine RW-treatment alone was inferior in both the fastnesses as bad as classes 1–2, but the cloth according to the present process maintained superior fastnesses as good as classes 4–5.

What is claimed is:

1. A process for producing modified synthetic fibers having antistatic, hydrophylic and anti-fouling properties which comprises adhering onto the surface of synthetic fibers, 0.2–8% by weight based on the weight of the fibers of a reaction product of either one of a s-triazine derivative or a piperazine derivative of the general formula (I)-A

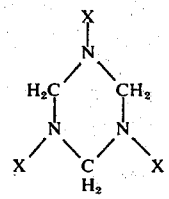

or (I)-B

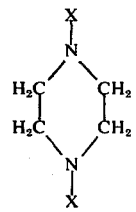

wherein, X is $-CH_2CH{=}CH_2$, $-COCH{=}CH_2$, $-COC(CH_3){=}CH_2$, $-COC(Cl){=}CH_2$ or $-COCH_2CH_2Cl$, with a compound of the general formula $$X'+R_nX' \qquad \text{(II)}$$

wherein X′ is $—NH_2$, $—NHCH_3$, $—SO_2NH_2$, $—SO_2CH_2CH_2NH_2$ or $—COCH_2NH_2$; R is oxyethylene; and *n* is an integer at which the molecular weight of the compound of the general formula (II) falls within the range of 200 – 5,000, and thereafter adhering onto the surface of the resulting fibers, 0.05 – 3% by weight based on the weight of the fibers of an aromatic sulfonic acid of the general formula (III)

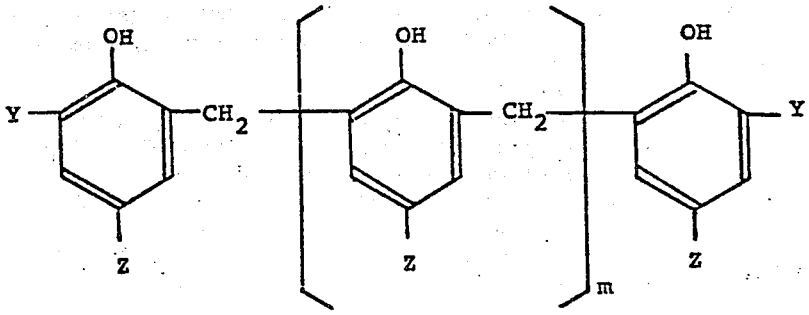

wherein Y is —H, $—CH_2OH$ or $—CH_2SO_3H$; Z is $—SO_3H$, $—CH_2SO_3H$,

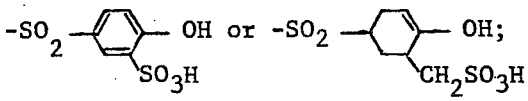

and *m* is an integer of 5–20.

2. A process according to claim 1 wherein X in the general formula (I)-A or (I)-B is $—CH_2CH{=}CH_2$, $—COCH{=}CH_2$ or

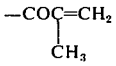

and Z in the general formula (II) is

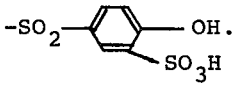

3. A process according to claim 1 wherein the compound expressed by the general formula (I)-a is 1,3,5-tris-acryloyl-hexahydro-s-triazine; the compound expressed by the general formula (II) is diamino-polyoxyethylene glycol; and the compound expressed by the general formula (III) is the sulfonated product of 4,4′-dihydroxy-diphenylsulfone-formaldehyde condensate.

4. A process for producing modified synthetic fibers having antistatic, hydrophylic and anti-fouling properties which comprises adhering onto the surface of synthetic fibers, 0.5 – 4% by weight based on the weight of the fibers of a reaction product of either one of a s-triazine derivative or a piperazine derivative of the general formula (I)-A

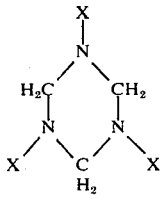

or (I)-B

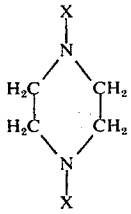

wherein X is $—CH_2CH{=}CH_2$, $—COCH{=}CH_2$,

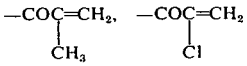

or $—COCH_2CH_2Cl$, with a compound of the general formula $$X'\text{-}(R)_n\text{-}X' \qquad \text{(II)}$$

wherein X′ is $—NH_2$, $—NHCH_3$, $—SO_2NH_2$, $—SO_2CH_2CH_2NH_2$ or $—COCH_2NH_2$; R is oxyethylene; and *n* is an integer at which the molecular weight of the compound of the general formula (II) falls within the range of 400–3,000, and thereafter adhering onto the surface of the resulting fibers, 0.1–2% by weight based on the weight of the fibers of an aromatic sulfonic acid of the general formula (III)

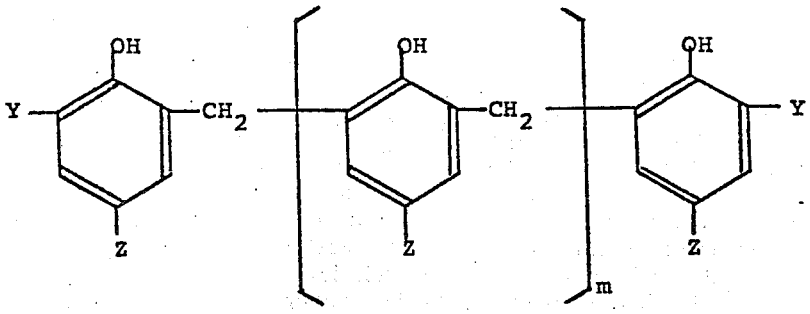

wherein Y is —H, $-CH_2OH$ or $-CH_2SO_3H$; Z is $-SO_3H$, $-CH_2SO_3H$,

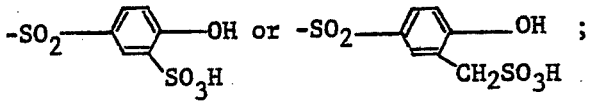

and $m$ is an integer of 8–15.

5. A process according to claim 4 wherein X in the general formula (I)-A or (I)-B is $-CH_2CH{=}CH_2$, $-COCH{=}CH_2$ or

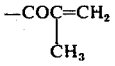

and Z in the general formula (II) is

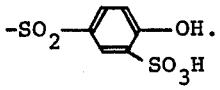

6. A process according to claim 4 wherein the compound expressed by the general formula (I)-a is 1,3,5-tris-acryloyl-hexahydro-s-triazine; the compound expressed by the general formula (II) is diaminopolyoxyethylene glycol; and the compound expressed by the general formula (III) is the sulfonated product of 4,4′-dihydroxy-diphenylsulfone-formaldehyde condensate.

7. A modified synthetic fiber having antistatic, hydrophilic, and anti-fouling properties consisting essentially of a synthetic fiber having adhered to the surface thereof: (a) 0.2–8% by weight based on the weight of the fiber of a reaction product of either one of a s-triazine derivative or a piperazine derivative of the general formula (I)-A

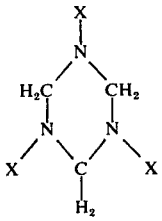

or (I)-B

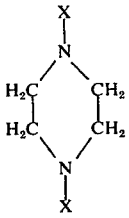

wherein X is $-CH_2CH{=}CH_2$, $-COCH{=}CH_2$,

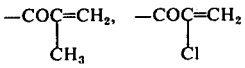

or $-COCH_2CH_2Cl$, with a compound of the general formula $$X'-(R)_n-X' \qquad \text{(II)}$$

wherein X′ is $-NH_2$, $-NHCH_3$, $-SO_2NH_2$, $-SO_2CH_2CH_2NH_2$ or $-CO\,CH_2NH_2$; R is an oxyethylene group; and $n$ is an integer such that the molecular weight of the compound of the general formula (II) falls within the range of 200–5,000, and (b) 0.05–3% by weight based on the weight of the fiber of an aromatic sulfonic acid of the general formula (III)

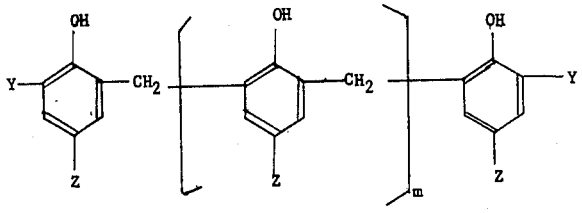

wherein Y is —H, $-CH_2OH$ or $-CH_2SO_3H$; Z is $-SO_3H$, $-CH_2SO_3H$,

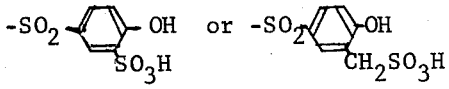

and $m$ is an integer of 5–20.

8. The fiber of claim 7 wherein X in the general formula (I)-A or (I)-B is $-CH_2CH{=}CH_2$, $-COCH{=}CH_2$ or

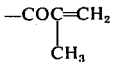

and Z in the general formula (II) is

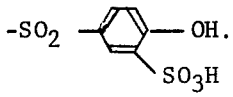

9. The fiber of claim 7 wherein the compound of the general formula (I)-a is 1,3,5-tris-acryloyl-hexahydro-s-triazine; the compound of the general formula (II) is diaminopolyoxyethylene glycol; and the compound of the general formula (III) is the sulfonated product of 4,4′-dihydroxy-diphenylsulfone-formaldehyde condensate.

10. The fiber of claim 7 wherein the amount of reaction product (a) adhered to the synthetic fiber is 0.5–4% by weight based on the weight of the fiber; $n$ is an integer such that the molecular weight of (II) falls within the range of 400–3000; the amount of the aromatic sulfonic acid (b) is 0.1–2% by weight based on the weight of the fiber; and $m$ is an integer of 8–15.

11. The fiber of claim 10 wherein X in the general formula (I)-A or (I)-B is $-CH_2CH{=}CH_2$, $-COCH{=}CH_2$ or

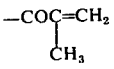

and (II) is

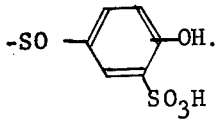

12. The fiber of claim 10 wherein the compound of the general formula (i) is 1,3,5-tri-acryloyl-hexahydro-s-triazine; the compound of the general formula (II) is diaminopolyoxyethylene glycol; and the compound of the general formula (III) is the sulfonated product of 4,4′ - dihydroxy-diphenylsulfone-formaldehyde condensate.

* * * * *